US005852456A

United States Patent [19]

Okada et al.

[11] Patent Number: 5,852,456

[45] Date of Patent: Dec. 22, 1998

[54] PLATE ASSEMBLY SUITABLE FOR INK-JET-TYPE PRINTING HEAD

[75] Inventors: Shigeki Okada; Natsumi Shimogawa, both of Nagoya; Nobou Takahashi, Owariasahi, all of Japan

[73] Assignees: NGK Insulators, Ltd.; Seiko Epson Corp., both of Japan

[21] Appl. No.: 280,648

[22] Filed: Jul. 25, 1994

[30] Foreign Application Priority Data

Jul. 26, 1993 [JP] Japan ..... 5-183625

[51] Int. Cl.[6] ..... B41J 2/045

[52] U.S. Cl. ..... 347/71; 310/328

[58] Field of Search ..... 347/20, 54, 68, 347/70, 71, 63, 65; 310/328, 330, 331, 332; 156/84, 85, 306.6

[56] References Cited

U.S. PATENT DOCUMENTS

| | | | |
|---|---|---|---|
| 4,383,264 | 5/1983 | Lewis | 347/68 |
| 4,678,529 | 7/1987 | Drake et al. | 347/63 X |

FOREIGN PATENT DOCUMENTS

| | | | |
|---|---|---|---|
| 0584823 | 3/1994 | European Pat. Off. | 347/71 |
| 56-117666 | 9/1981 | Japan | B41J 3/04 |
| 61-50785 | 11/1986 | Japan | B41J 3/04 |
| 63-260455 | 10/1988 | Japan | B41J 3/04 |
| 4341855 | 11/1992 | Japan | 347/71 |
| 6-114550 | 4/1994 | Japan | B23K 1/20 |

*Primary Examiner*—N. Le
*Assistant Examiner*—C. Dickens
*Attorney, Agent, or Firm*—Wall Marjama Bilinski & Burr

[57] ABSTRACT

A plate assembly for ink-jet-type printing head assures a smooth ink flow and prohibits fluctuation in ink discharge quantity and speed to realize a satisfactory printing quality. A plurality of plates are bonded each other by using a thermoplastic-resin intermediate sheet having a shape corresponding to the opposite surfaces of adjacent plates. The intermediate sheet has ink passage openings of a dimension which includes a reference contour which is an axial projection of a corresponding opening in the plate. The ink passage opening in the intermediate sheet has a periphery which is set-back from the reference contour by a predetermined amount in the reference direction connecting adjacent ink passage openings, and by an increased amount in other directions. The plates and the intermediate sheet are superimposed one above the other and subsequently heated under pressure to form an integral plate assembly.

15 Claims, 8 Drawing Sheets

PLATE ASSEMBLY SUITABLE FOR INK-JET-TYPE PRINTING HEAD

BACKGROUND OF THE INVENTION

1. Field of the Invention

The present invention relates to a plate assembly which can be suitably used, e.g., for an ink-jet-type printing head. The present invention also pertains to a method for manufacturing such plate assemblies with an improved manufacturing productivity.

2. Description of Related Art

Various types of ink-jet-type printing heads are known and practically used, each having a pressure chamber filled with ink which has been supplied thereto from a reservoir, and a plurality of nozzles for discharging the ink which has been pressurized within the chamber. In this instance, a pressure source is associated with the pressure chamber and ink passages are formed in the printing head for connecting the reservoir with the pressure chamber and for connecting the latter with the nozzles.

Among other things, there is known one type of ink-jet-type printing head which comprises at least one plate assembly including a plurality of plates which are formed with one or more openings corresponding to the passages nozzles and/or pressure chamber in the printing head. In this type of plate assembly, the plates are typically bonded to each other with an intermediate sheet of thermoplastic resin interposed between adjacent plates. More particularly, the plates and the intermediate sheet are superimposed one above the other, and integrated into an assembly by heating them under pressure. The plate assembly prepared as above can be used either as a nozzle/passage plate assembly or as a pressure chamber plate assembly. Furthermore, there may be instances wherein the nozzle/passage plate assembly and the pressure chamber plate assembly are integrated into an unitary head unit, by interposing a similar intermediate sheet of thermoplastic resin between the two assemblies.

This type of ink-jet-type printing head proved to be particularly advantageous in that a highly compact and precise arrangement of the printing head having an elaborate internal structure can be realized with an improved manufacturing productivity and at a low cost. However, since the intermediate sheet comprising a thermoplastic resin is interposed between the plates of adjacent plates of a plate assembly or between adjacent plate assemblies, depending upon the dimension of the openings which have to be formed in the intermediate sheet corresponding to those of the plates, there may occur problems which have to be overcome to provide a further improved characteristics of the printing head by some way or other. That is to say, there had been instances wherein molten thermoplastic resin of the intermediate sheet undergoes an excessive flow during formation of the integral plate assembly or unit under an elevated temperature condition, whereby the cross-sectional area of the passages is restricted making it difficult to realize a satisfactory discharge property of ink out of the nozzles, i.e., constant ink discharge volume and speed without fluctuations.

One may thus think of increasing the dimension of the openings in the intermediate sheet so as to avoid formation of restriction in the ink flow passage due to a heat-induced flow of the thermoplastic resin. However, it has been confirmed that an increased dimension of the openings in the intermediate sheet tends to cause an insufficient flow of the thermoplastic resin, thereby giving rise to formation of a local recess in the ink flow passage, which also deteriorates the ink discharge property, In the case of an ink-jet-type printing head, unsatisfactory discharge property of ink out of the nozzles often results in deteriorated printing quality. Therefore, formation of smooth fluid passages is highly important to assure a satisfactory function of the printing head.

Similar problems may occur when one or more plate assemblies are used in high precision devices other than ink-jet-type printing heads, e.g., an integrated fluid logic circuit. In this case, too, formation of smooth fluid passages is important to assure a satisfactory function of the device.

SUMMARY OF THE INVENTION

It is therefore an object of the present invention to provide an improved plate assembly which includes an intermediate sheet of thermoplastic resin interposed between adjacent plates, and which yet affords smooth fluid passages wherein the periphery of the opening in the intermediate sheet is substantially flush with the corresponding periphery of the opening in the plate.

The present invention is based on a novel recognition achieved by thorough experimental studies, that, in the region of openings in the intermediate sheet, the amount of resin flowing toward inside of the passage as a result of heating under pressure is dependent, not only upon the thickness and/or physical property of the sheet, heating temperature, pressure, physical property of the plates, but also upon the geometry of the sheet. It has been found that, during the heating under pressure, the amount of resin which tends to flow toward inside of the passage is not always uniform along the periphery of the opening. Specifically, with reference to the resin flow amount in a reference direction connecting adjacent passage openings in the sheet, a relatively large amount of resin tends to flow toward inside of the passage in directions other than the reference direction.

Thus, according to a first aspect of the present invention, there is provided a plate assembly comprising;

first and second plates having opposite surfaces of a predetermined shape, the first and second plates each having a plurality of openings for passing a fluid therethrough, including at least one opening which is aligned with at least one corresponding opening in the opposite plate; and an intermediate sheet having a shape which substantially corresponds to the shape of the surfaces of the first and second plates, the intermediate sheet being interposed between the first and second plates and bonding the first and second plates with each other, and having at least one opening which is aligned with said at least one opening in each of the first and second plates, the opening in the intermediate sheets being defined by a periphery which is substantially flush with a periphery of the corresponding opening in at least one of the first and second plates;

the intermediate sheet comprising a thermoplastic resin which has been heated under pressure, the periphery of said at least one opening in the intermediate sheet, before it is heated, being set-back from the periphery of the corresponding opening in said at least one of the first and second plates, by a first set-back amount in a first direction connecting the openings in each of the first and second plates, and by a second set-back amount in a second direction which is different from the first direction, the second set-back amount being greater than the first set-back amount.

The plate assembly of such a structure is particularly suitable for an ink-jet-type printing head. In this case, the openings in the first and second plates and intermediate sheet, which are aligned with each other, form a discharge nozzle for ink. The discharge nozzle is then in communication with a pressure chamber having a variable volume, in which ink can be pressurized. The pressure chamber may be associated with a piezoelectric actuator for changing the volume of the pressure chamber when an with operating voltage is applied. Such a piezoelectric actuator may be provided on a wall of the pressure chamber, and arranged either inside or outside of the pressure chamber.

According to a second aspect of the present invention, there is provided a plate assembly for an ink-jet-type printing head, comprising;

first and second plates having opposite surfaces of a predetermined shape, the first plate having a plurality of openings for passing ink therethrough as discharge nozzles for the ink, and the second plate defining at least part of a pressure chamber having a variable volume, which is in communication with the discharge nozzles and in which the ink can be pressurized; and an intermediate sheet having a shape which substantially corresponds to the shape of the surfaces of the first and second plates, the intermediate sheet being interposed between the first and second plates and bonding the first and second plates with each other, and having at least one opening which is aligned with said at least one opening in the first plate, the opening in the intermediate sheet being defined by a periphery which is substantially flush with a periphery of the corresponding opening in the first plate;

the intermediate sheet comprising a thermoplastic resin which has been heated under pressure, the periphery of said at least one opening in the intermediate sheet, before it is heated, being set-back from the periphery of the corresponding opening in the first plate, by a first set-back amount in a first direction connecting the openings in the first plate, and by a second set-back amount in a second direction which is different from the first direction, the second set-back amount being greater than the first set-back amount.

The pressure chamber may be associated with a piezoelectric actuator for changing the volume of the pressure chamber. The piezoelectric actuator may be provided on a wall of the pressure chamber, and arranged either inside or outside of the pressure chamber.

According to a third aspect of the present invention, there is provided a method for manufacturing a plate assembly, comprising the steps of:

providing first and second plates having opposite surfaces of a predetermined shape, the first and second plates each having a plurality of openings for passing therethrough a fluid in use, including at least one opening which is to be aligned with at least one corresponding opening in the opposite plate;

placing between the first and second plates an intermediate sheet comprising a thermoplastic resin and having a shape which substantially corresponds to the shape of the surfaces of the first and second plates, the intermediate sheet having at least one opening which is brought into alignment with said at least one opening in each of the first and second plates, the periphery of said at least one opening in the intermediate sheet being set-back from the periphery of the corresponding opening in said at least one of the first and second plates, by a first set-back amount in a first direction connecting the openings in each of the first and second plates, and by a second set-back amount in a second direction which is different from the first direction, the second set-back amount being greater than the first set-back amount; and heating the first and second plates and the intermediate sheet under pressure thereby bonding the first and second plates with each other, such that the opening in the intermediate sheet is defined by a periphery which is substantially flush with a periphery of the corresponding opening in at least one of the first and second plates.

According to a fourth aspect of the present invention, there is provided a method for manufacturing a plate assembly for an ink-jet-type printing head, comprising the steps of;

providing first and second plates having opposite surfaces of a predetermined shape, the first plate having a plurality of openings for passing ink therethrough as discharge nozzles for the ink, and the second plate defining at least part of a pressure chamber having a variable volume, which is to be brought into communication with the discharge nozzles and in which the ink can be pressurized;

placing between the first and second plates an intermediate sheet comprising a thermoplastic resin and having a shape which substantially corresponds to the shape of the surfaces of the first and second plates, the intermediate sheet having at least one opening which is brought into alignment with said at least one opening in the first plate, the periphery of said at least one opening in the intermediate sheet being set-back from the periphery of the corresponding opening in the first plate, by a first set-back amount in a first direction connecting the openings in the first plate, and by a second set-back amount in a second direction which is different from the first direction, the second set-back amount being greater than the first set-back amount; and heating the first and second plates and the intermediate sheet under pressure thereby bonding the first and second plates with each other, such that the opening in the intermediate sheet is defined by a periphery which is substantially flush with a periphery of the corresponding opening in the first plate.

In this connection, it should be noted that the first and second plates in the assembly according to the first and third aspects of the invention may not be the same as the first and second plates in the assembly according to the second and fourth aspects of the present invention. Likewise, the first and second set-back amounts in the plate assembly according to the first and third aspects of the invention may not be same as the first and second set-back amounts in the plate assembly according to the second and fourth aspects of the present invention.

BRIEF DESCRIPTION OF THE DRAWINGS

The present invention will now be explained in further detail by referring to a preferred embodiment shown in the accompanying drawings, in which.

DESCRIPTION OF THE PREFERRED EMBODIMENT

Figure 1:
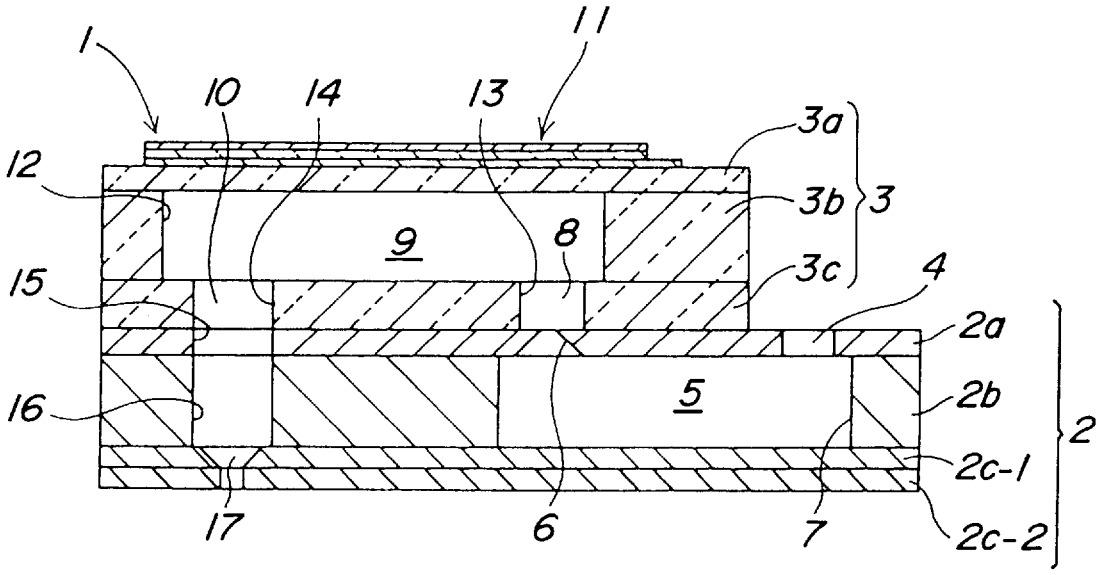
FIG. 1 is a sectional view showing one example of an ink-jet-type printing head to which the present invention can be applied.
Figure 2:
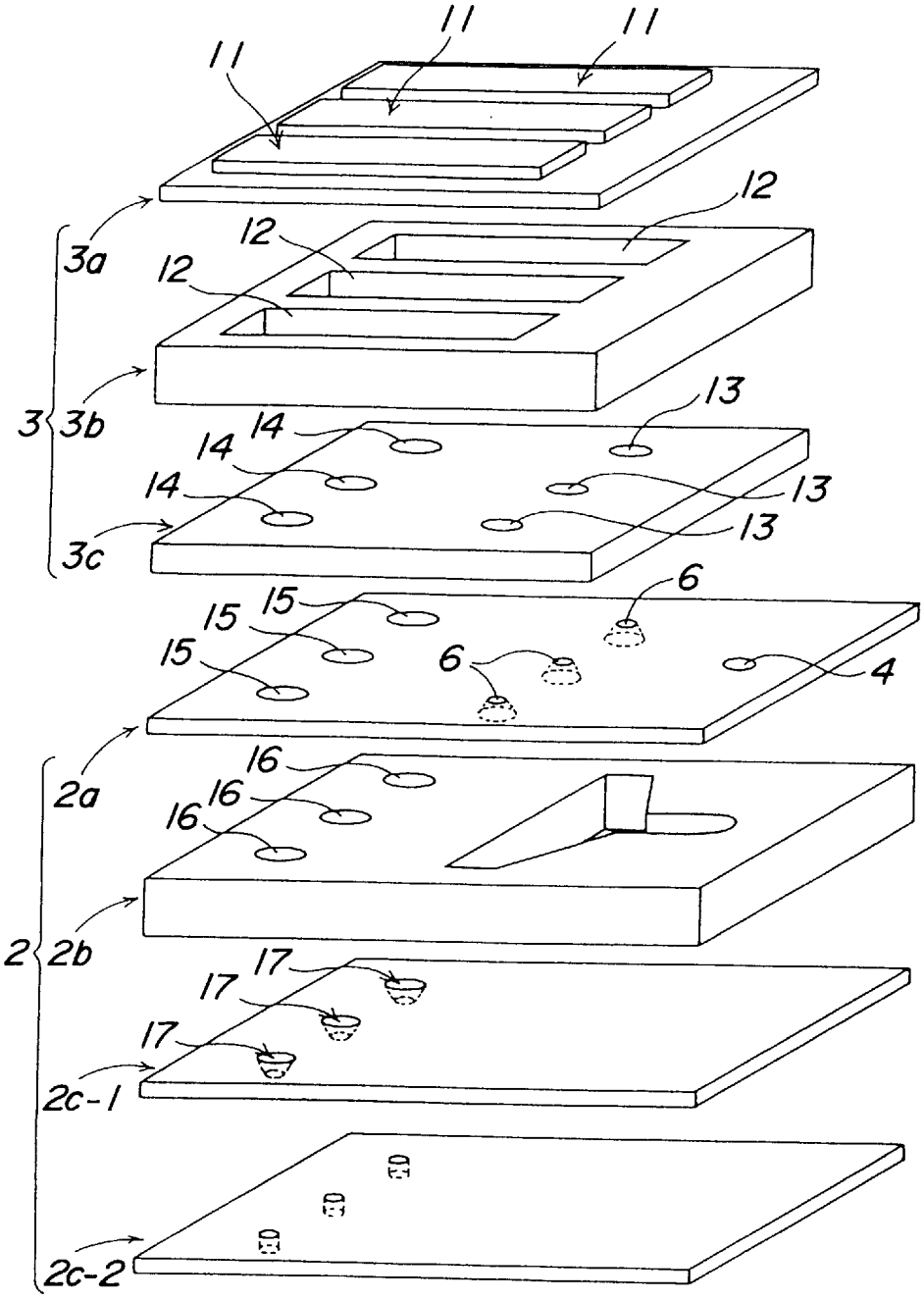
FIG. 2 is an exploded perspective view showing the plates forming the printing head of FIG. 1.
Figure 3:
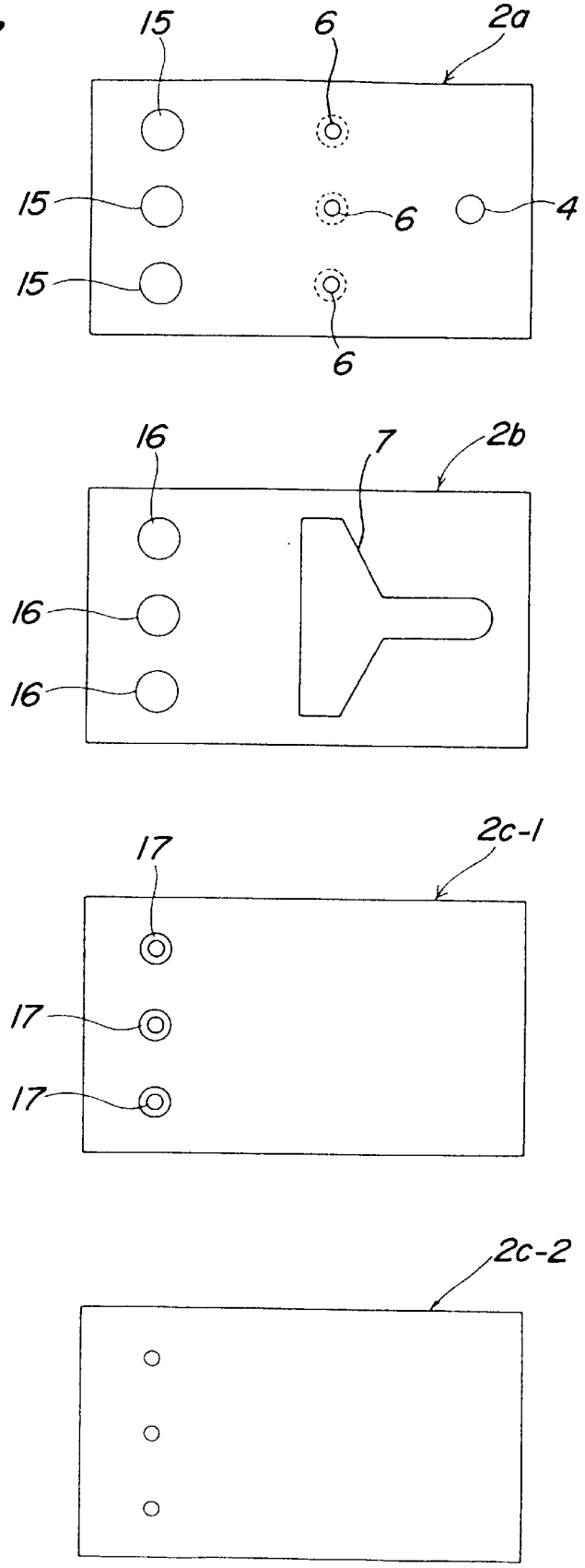
FIG. 3 is a plan view of the plates forming a nozzle/passage plate assembly.

FIG. 1 is a sectional view showing one example of an ink-jet-type printing head to which the present invention can be applied. The printing head 1 is formed by superimposing a plurality of plates which are shown in FIG. 2. As shown in FIGS. 1 to 3, the printing head 1 comprises a nozzle plate assembly 2 which includes an orifice plate 2*a,* a channel plate 2*b* and nozzle plates 2*c*-1, 2*c*-2. The printing head 1 further comprises a pressure chamber plate assembly 3 which includes a cover plate 3*a,* a spacer plate 3*b,* and a connection plate 3*c*. An ink feed passage 4 connected to an ink reservoir (not shown) an ink feed channel 5, first orifices 6 and first communication holes 8 are formed in the printing head 1 and arranged on the upstream side of the pressure chamber 9 in which ink can be pressurized. The pressure chamber 9 is thus in communication with the ink feed passage 4 through the ink feed channels, the first orifices 6 and the first communication holes 8. A piezoelectric actuator 11 is arranged on the cover plate 3*a* of the pressure chamber plate assembly 3, and serves to generate a pressure across the pressure chamber 9 by displacing the cover plate 3*a* downward, so as to pressurize ink within the chamber 9.

As shown in FIG. 2, on the downstream side of the pressure chamber 9, the connection plate 3*c* is provided with first openings 13 forming the first communication passages 8 in FIG. 1, second openings 14 forming the second communication passages 10, second orifices 15 connecting the second communication passages 10 and through-holes 16 which are connected to discharge nozzles 17. Ink which has been pressurized within the pressure chamber 9 is thus discharged from the nozzles 17, through the second openings 14, second orifices 15 and the through-holes 16.

The nozzle member 2 is in the form of a plate assembly, including an orifice plate 2*a,* a channel plate 2*b* and nozzle plates 2*c*-1 and 2*c*-2. These plates are bonded to each other into an integral assembly, by interposing intermediate sheets 18 and 19' which are composed of a thermoplastic resin and formed into a shape corresponding to the opposite surface of adjacent plates, as shown in FIG. 4, and subsequently applying heat under pressure.

Figure 5A:
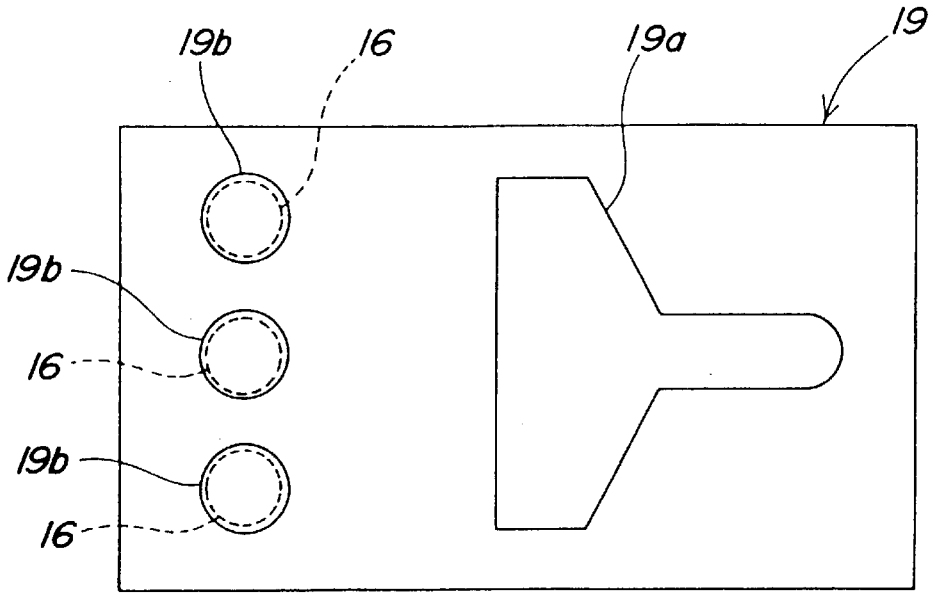
PRIOR ART FIG 5A
FIG. 5A is a plan view showing a conventional intermediate sheet.
Figure 5B:
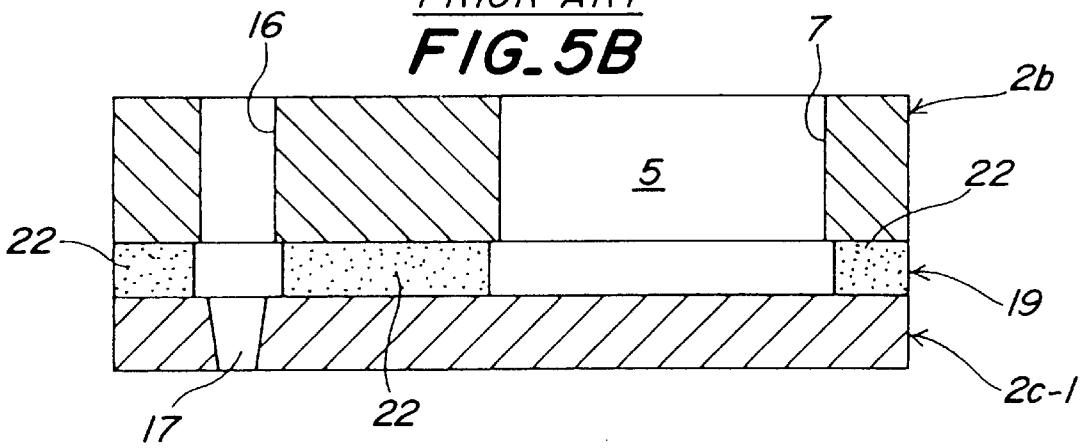
PRIOR ART FIG 5B
FIG. 5B is a sectional view showing the intermediate sheet of FIG. 5A interposed between a passage plate and a nozzle plate, and illustrating the state before the heating step.
Figure 5C:
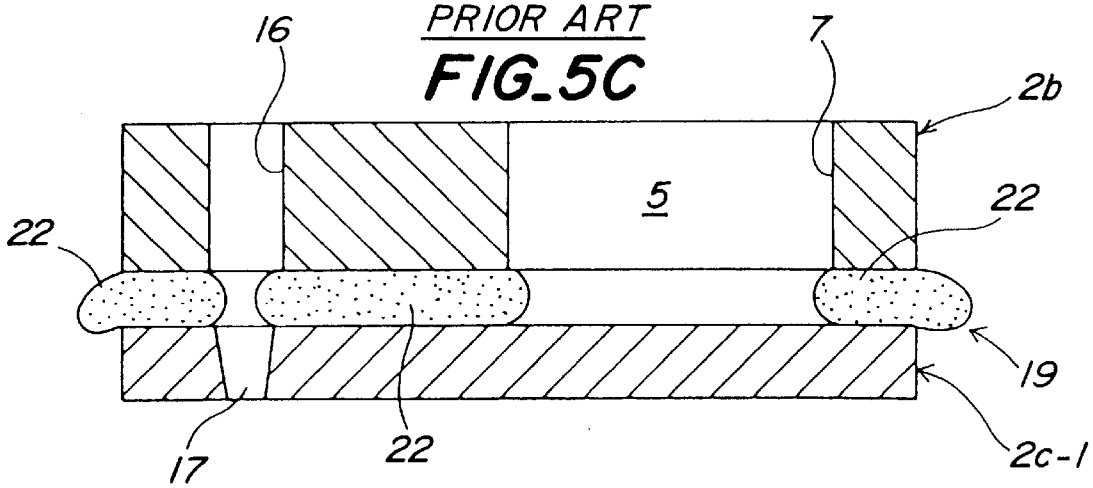
PRIOR ART FIG 5C
FIG. 5C is a sectional view similar to FIG. 5B, illustrating one example of the state after the heating step.

FIGS. 5A to 5C show the steps for forming the plate assembly 2 by bonding the channel plate 2*b* and the nozzle plate 2*c*-1 with each other, using a conventional intermediate sheet 19 composed of a thermoplastic resin. The intermediate sheet 19 has a relatively large opening 19*a* which corresponds to the feed channel 5, and a plurality of openings or holes 19*b* to be aligned with the through-holes 16 and the discharge nozzles 17 in adjacent plates 2*b,* 2*c*-1. As shown in FIG. 5A, the diameter of the hole 19*b* in the intermediate sheet 19 is slightly larger than the diameter of the through-hole 16 and that of the nozzle 17 on its upstream side. Therefore, the periphery of the through hole 16 on its downstream side and the entrance of the nozzle 17 are not covered by the intermediate sheet 19 when the thermoplastic resin is molten due to application of heat under pressure and thereby undergoes an expansion between opposite plate surfaces.

As mentioned hereinabove, when adjacent plates and an intermediate sheet are superimposed one above the other and subsequently heated under pressure at a predetermined temperature/pressure condition, the amount of the resin expanding between the plates is enhanced in directions other than the reference direction connecting adjacent ink passage openings. Thus, the quantity of the resin flowing toward the periphery or inside of the opening in the intermediate sheet is highly dependent upon the geometrical condition around the openings in question.

Figure 4:
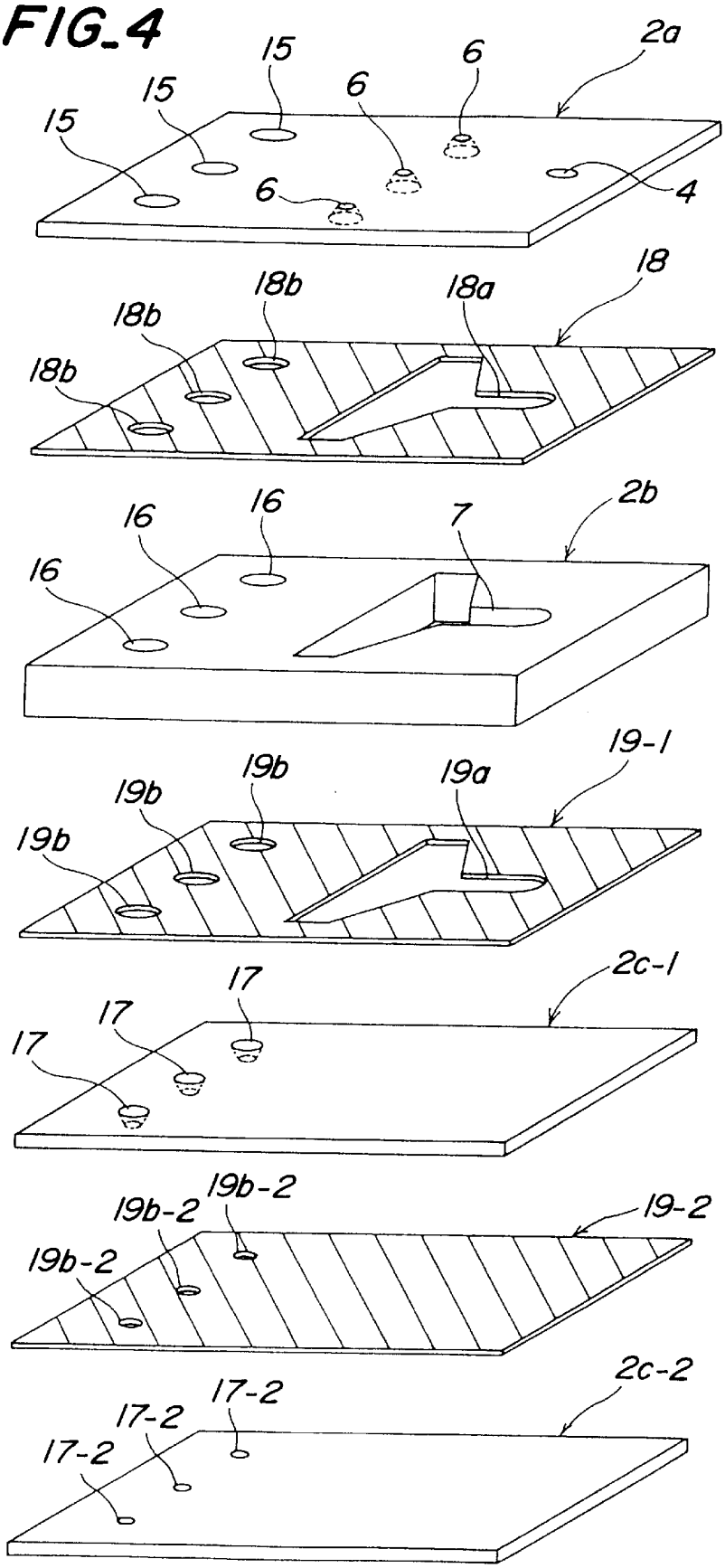
FIG. 4 is an exploded perspective view showing the intermediate sheets which are interposed between adjacent plates of the nozzle/passage plate assembly.

In the conventional intermediate sheet 18, 19, as shown In FIGS. 4 and 5, the openings 18*b,* 19*b* in the intermediate sheets 18, 19 are formed into a shape which is in conformity with the shapes of the through holes or nozzles, or which is concentric but slightly larger than the shape of the through holes or nozzles, regardless of the surface area of the intermediate sheet around the openings. Thus, the amount of resin flowing in the directions other than the reference direction connecting adjacent openings tends to increase, and molten thermoplastic resin 22 may protrude inside of the through hole 16 and the nozzle 17.

Figure 6:
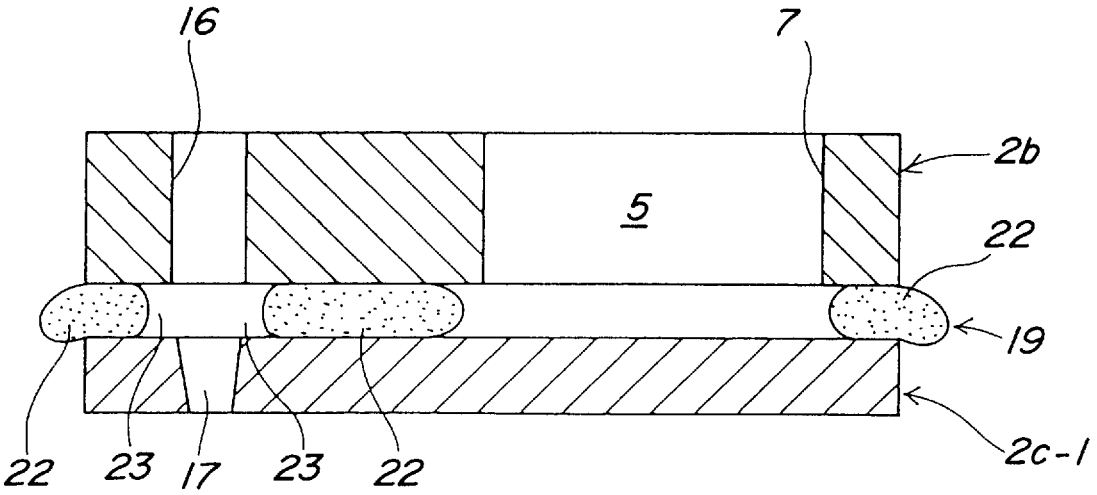
FIG. 6 is a sectional view similar to FIG. 5B, illustrating another example of the state after the heating step.

In this instance, the discharge quantity of ink tends to decrease or fluctuate, making It difficult to achieve a satisfactory printing quality. One may thus consider it desirable to increase the diameter of the opening 19*b* in the intermediate sheet. However, a substantially annular dead space or stagnant region 23 as shown in FIG. 6 may be formed between the intermediate sheet 19 and adjacent plates, which prohibits a smooth discharge of ink and thereby makes it difficult to realize a satisfactory printing quality.

The method for manufacturing the plate assemblies according to the present invention will be further explained below in connection with the nozzle plate assembly 2.

As shown in FIG. 4, the plates forming the nozzle plate assembly 2 are bonded by using an intermediate sheet 18 having a shape corresponding to the opposite surfaces of the orifice plate 2*a* and the channel plate 2*b,* an intermediate sheet 19-1 having shape corresponding to the opposite surfaces of the channel plate 2*b* and the nozzle plate 2*c*-1, and an intermediate sheet 19-2 having a shape corresponding to the opposite surfaces of the nozzle plates 2*c*-1, 2*c*-2. The plates 2*a,* 2*b,* 2*c*-1, 2*c*-2 and the intermediate sheets 18, 19-1 19-2 are superimposed one above the other such that the intermediate sheet 18 is interposed between the plates 2*a,* 2*b,* the intermediate sheet 19-1 is interposed between the plates 2*b,* 2*c*-1 and the intermediate sheet 19-2 is interposed between the plates 2*c*-1, 2*c*-2. The plates 2*a,* 2*b,* 2*c*-1, 2*c*-2 and the intermediate sheets 18, 19-1, 19-2 are then heated under pressure, at a predetermined temperature/pressure condition, thereby causing the thermoplastic resin of the intermediate sheets to melt and flow.

Figure 7A:
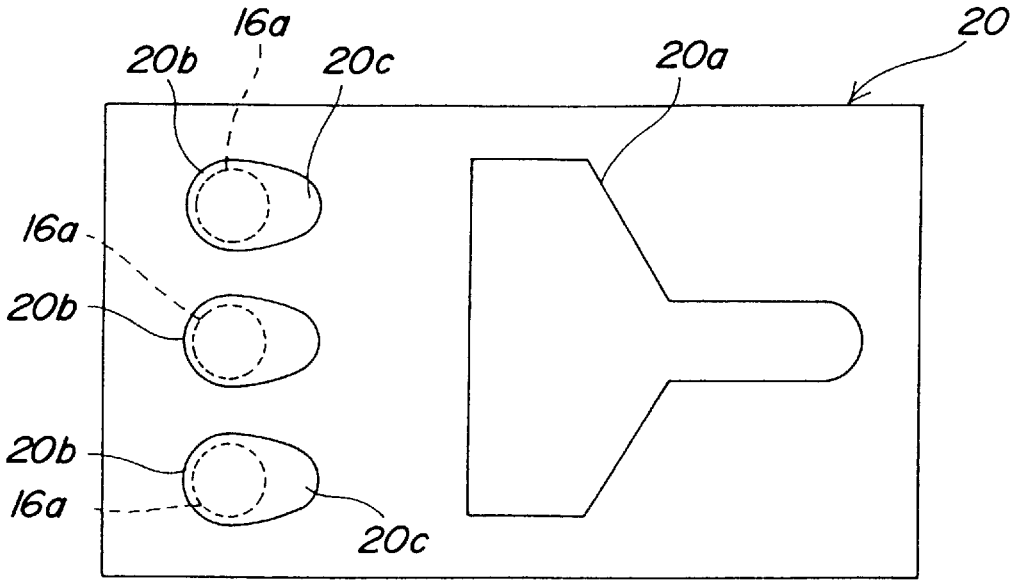
FIG. 7A is an plan view showing a intermediate sheet which can be used according to the present invention.
Figure 7B:
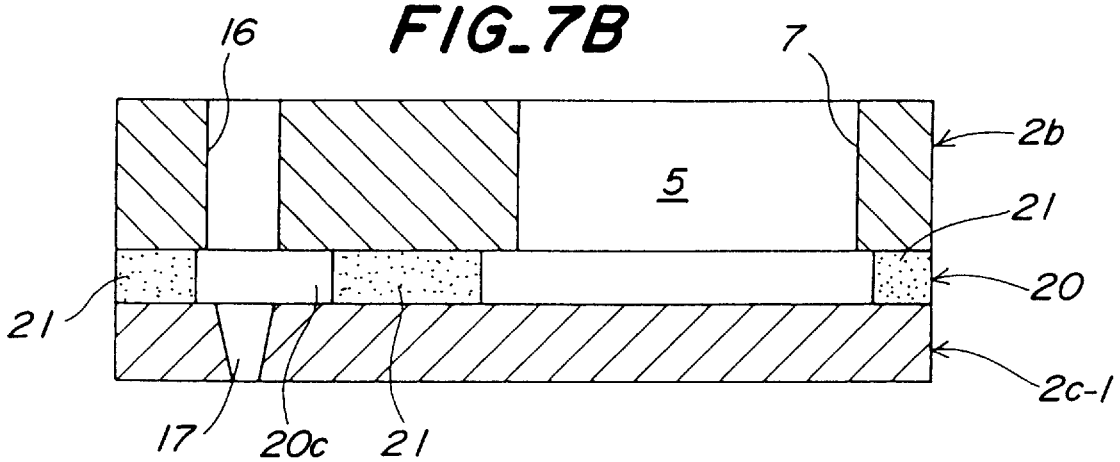
FIG. 7B is a sectional view showing the intermediate sheet of FIG. 7A interposed between a passage plate and a nozzle plate, and illustrating the state before the heating step.
Figure 7C:
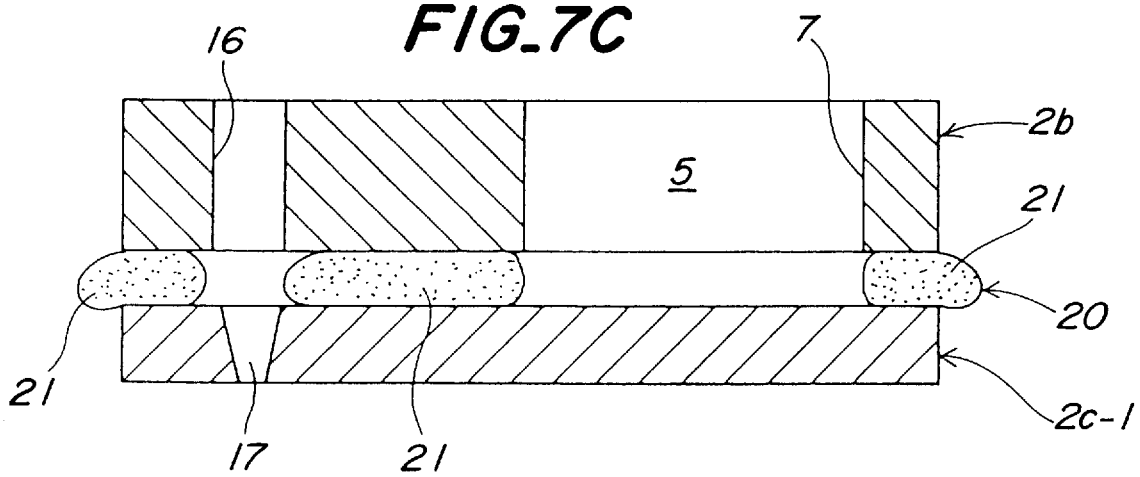
FIG. 7C is a sectional view similar to FIG. 7B, illustrating the state after the heating steps

FIGS. 7A to 7C are illustrations showing the steps of bonding the channel plate 2*b* and the nozzle plate 2*c*-1. As shown in FIG. 7A, an intermediate sheet 20 composed of a thermoplastic resin is used instead of the sheet 19, and has a shape corresponding to the opposite surfaces of the channel plate 2*b* and the nozzle plate 2*c*-1. The intermediate sheet 20 has a window-like opening 20*a* of a shape corresponding to the window-like opening 7 in the channel plate 2*b,* and ink passage openings 20*b* arranged at positions corresponding to the through holes 16 in the channel plate 2*b* and the nozzles 17 in the nozzle plate 2*c*-1. A reference contour 16*a,* which is the axial projection of the through-hole 16 in the channel plate 2*b,* serves as the basis for determining the periphery of the ink passage openings 20*b* in the intermediate sheet 20.

Figure 8:
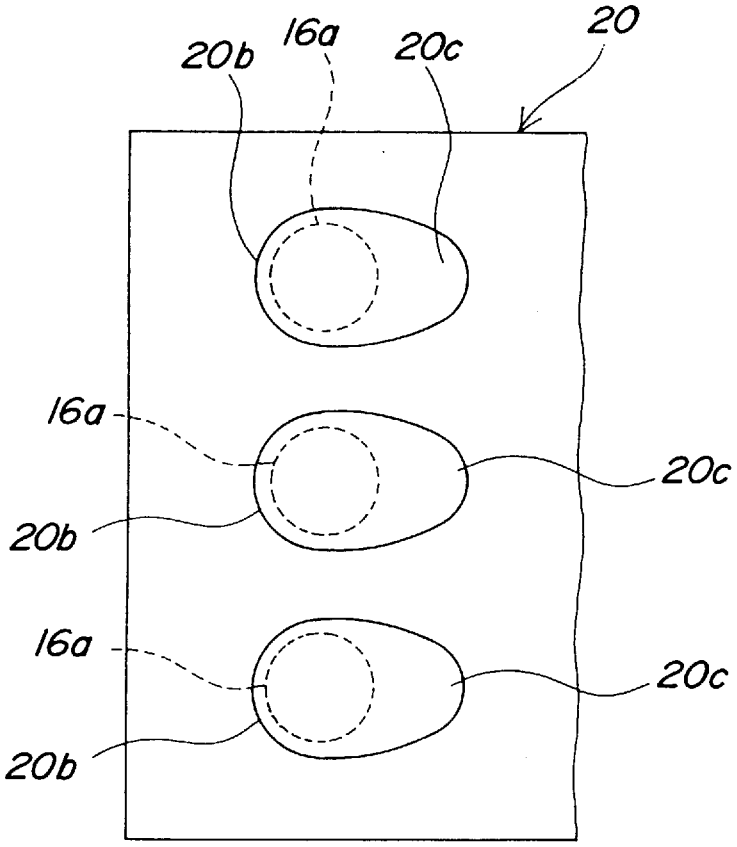
FIG. 8 illustrates a fragmentary plan view, in enlarged scale, of the intermediate sheet of FIG. 7A.

As more clearly shown in FIG. 8, the ink passage opening 20*b* includes the reference contour 16*a* and is formed so that a set-back amount of the periphery of the opening 20*b* as measured from the reference contour 16*a* in the reference direction connecting the adjacent ink passage openings 20*b* is minimized relative to the set-back amount as measured in the directions other than the above-mentioned reference direction.

In the case of the illustrated embodiment, the distance between the reference contour 16*a* and the window-like opening 20*a* is the largest, so that the ink passage opening 20*b* has a shape which maximizes the setback amount in the direction toward the window-like opening 20*a.* Therefore, a release portion 20*c* is formed by the enlarged shape of the ink passage opening 20*b.* FIG. 7B is a sectional view showing the state in which the intermediate sheet 20 is interposed between the channel plate 2*b* and the nozzle plate 2*c*-1, but not yet applied with heat under pressure.

When the channel plate 2*b* and the nozzle plate 2*c*-1 are subsequently heated under pressure at a predetermined temperature/pressure condition, the resin 21 forming the intermediate sheet 20 is molten and expanded between the adjacent plates. However, the molten resin does not exhibit a significant protrusion inside of the through hole 16 or nozzle 17, and no significant stagnant portion is formed between the intermediate sheet and the adjacent plates. The flow of the resin stops at a location corresponding substantially to the peripheries of the through hole 16 or nozzle 17.

After the thermoplastic resin has been cooled down, both plates are integrated into a plate assembly 2 in which the plates are maintained bonded to each other. It is thus possible to smoothly discharge ink through the nozzle without fluctuations in the discharge quantity and/or speed, thereby to provide a satisfactory printing quality.

The shape and size of the ink passage opening 20*b* depends upon the sizes and positions of the through hole 16, nozzle 17 and window-like opening 7 in the plate to be bonded, so that they are determined by previously examining the relationship with these parameters. Moreover, when determining the shape and size of the ink passage opening 20*b,* the range in which the resin expands due to heating under pressure also depends upon the thickness of the intermediate sheet, the composition of the resin, heating temperature and pressure and the composition of a plate to be bonded. Therefore, these parameters should also be taken into consideration.

Incidentally, the release region of the window-like opening 20*a* in the intermediate sheet 20 may be determined in consideration of the surface area of the intermediate sheet 20 around the opening 20*a,* so that molten resin is effectively prevented from protruding inside of the opening 20*a,* as shown in FIG. 7*c.*

The orifice plate 2*a* and the channel plate 2*b* are bonded to each other and integrated, by interposing an intermediate sheet between the both plates and subjecting the laminate to heating under pressure in essentially the same manner. Therefore, molten resin can be effectively prevented from protruding inside of the ink feed hole 4, first orifice 6 or second orifice 15, to assure a smooth flow of ink due to absence of protrusion or stagnant region.

It will be appreciated from the foregoing description that the present invention makes it possible to achieve a smooth flow of ink from the ink feed hole 4 to the nozzle 17, thereby to fully utilize the displacement characteristic of the piezoelectric actuator and provide a satisfactory printing quality with stable ink discharge quantity and ink. The openings in the intermediate sheet interposed between the adjacent plates to be bonded are designed to have a dimension determined in consideration of the flow amount of resin toward inside of the opening when heating under pressure takes place, thereby to prevent the molten resin from protruding inside of the ink passage opening or forming stagnant regions between the intermediate sheet and adjacent plates. This makes it readily possible to prevent the ink discharge quantity and speed from fluctuating, and to achieve a satisfactory printing quality.

While the present invention has been described with reference to a specific embodiment, it has been given by way of examples only. Various changes and modifications may be made without departing from the scope of the invention as defined by the appended claims. For example, it is possible to form the orifice plate 2*a* and the channel plate 2*b* as an integral sub-assembly by means of an injection molding process, and to laminate the nozzle plate 2*c*-2 alone or the nozzle plates 2*c*-1, 2*c*-2. Also, the method for manufacturing the nozzle plate assembly can be applied to integrally connect the nozzle plate assembly and the pressure chamber assembly.

We claim:

1. A plate assembly comprising:

first and second plates having opposite surfaces of a predetermined shape, said first and second plates each having a plurality of openings for passing a fluid therethrough, including at least one opening in one plate which is aligned with at least one corresponding opening in the other plate; and an intermediate sheet having a shape which substantially corresponds to the shape of said surfaces of the first and second plates, said intermediate sheet being interposed between the first and second plates and bonding the first and second plates with each other, and having at least one opening which is aligned with said at least one opening in each of said first and second plates, said opening in said intermediate sheet being defined by a periphery which is substantially flush with a periphery of the corresponding opening in at least one of said first and second plates;

said intermediate sheet comprising a thermoplastic resin which has been heated under pressure, the periphery of said at least one opening in said intermediate sheet, before the intermediate sheet is heated, being set-back from the periphery of the corresponding opening in said at least one of the first and second plates, by a first set-back amount in a first direction connecting said openings in each of said first and second plates, and by a second set-back amount in a second direction which is different from said first direction, said second set-back amount being greater than said first set-back amount.

2. The plate assembly of claim 1, wherein said plate assembly is adapted for an ink-jet-type printing head for discharging ink.

3. The plate assembly of claim 2, wherein said openings in said first and second plates and said intermediate sheet form a discharge nozzle for discharging the ink.

4. The plate assembly of claim 3, wherein said discharge nozzle is in communication with a pressure chamber having a variable volume, in which the ink can be pressurized.

5. The plate assembly of claim 4, further comprising a piezoelectric actuator associated with said pressure chamber for changing the volume of said pressure chamber.

6. The plate assembly of claim 5, wherein said piezoelectric actuator is provided on a wall of said pressure chamber.

7. The plate assembly of claim 6, wherein said piezoelectric actuator is arranged outside of the pressure chamber.

8. The plate assembly of claim 4, wherein said pressure chamber is formed by at least one plate.

9. The plate assembly of claim 8, wherein said at least one plate forming said pressure chamber includes at least one of said first and second plates.

10. The plate assembly of claim 8, wherein said at least one plate forming said pressure chamber comprises a third sheet which is bonded to one of said first and second plates.

11. The plate assembly of claim 10 further comprising a second intermediate sheet having a shape which substantially corresponds to the shape of an opposite surface of said one of the first and second plates, said second intermediate sheet being interposed between said one of the first and second plates and said third plate, and having at least one opening which is aligned with said at least one opening in said one of the first and second plates, said opening in said second intermediate sheet being defined by a periphery which is substantially flush with a periphery of the corresponding opening in said one of said first and second plates; said second intermediate sheet comprising a thermoplastic resin which has been heated under pressure, the periphery of said at least one opening in said second intermediate sheet, before the second intermediate sheet is heated, being set-back from the periphery of the corresponding opening in said one of the first and second plates, by a third set-back amount in said first direction connecting said openings in each of said first and second plates, and by a fourth set-back amount in the second direction which is different from said first direction, said fourth set-back amount being greater than said third set-back amount.

12. A plate assembly for an ink-jet-type printing head, comprising first and second plates having opposite surfaces of a predetermined shape, said first plate having a plurality of openings for passing ink therethrough as discharge nozzles for the ink, and said second plate defining at least part of a pressure chamber having a variable volume, which is in communication with said discharge nozzles and in which the ink can be pressurized; and an intermediate sheet having a shape which substantially corresponds to the shape of said surfaces of the first and second plates, said intermediate sheet being interposed between the first and second plates and bonding the first and second plates with each other, and having at least one opening which is aligned with said at least one opening in said first plate, said opening in said intermediate sheet being defined by a periphery which is substantially flush with a periphery of the corresponding opening in said first plate;

said intermediate sheet comprising a thermoplastic resin which has been heated under pressure, the periphery of said at least one opening in said intermediate sheet, before the intermediate sheet is heated, being set-back from the periphery of the corresponding opening in said first plate, by a first set-back amount in a first direction connecting said openings in said first plate, and by a second set-back amount in a second direction which is different from said first direction, said second set-back amount being greater than said first set-back amount.

13. The plate assembly of claim 12, further comprising a piezoelectric actuator associated with said pressure chamber for changing the volume of said pressure chamber.

14. The plate assembly of claim 13 wherein said piezoelectric actuator is provided on a wall of said pressure chamber.

15. The plate assembly of claim 14 wherein said piezoelectric actuator is arranged outside of the pressure chamber.

* * * * *